US010871077B2

(12) United States Patent
Stoliaroff-Pepin

(10) Patent No.: US 10,871,077 B2
(45) Date of Patent: Dec. 22, 2020

(54) TURBOMACHINE AUXILIARY LEAD-THROUGH DEVICE

(71) Applicant: SNECMA, Paris (FR)

(72) Inventor: Nicolas Stoliaroff-Pepin, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 14/892,986

(22) PCT Filed: May 21, 2014

(86) PCT No.: PCT/FR2014/051182
§ 371 (c)(1),
(2) Date: Apr. 22, 2019

(87) PCT Pub. No.: WO2014/188122
PCT Pub. Date: Nov. 27, 2014

(65) Prior Publication Data

US 2016/0193753 A1 Jul. 7, 2016

(30) Foreign Application Priority Data

May 24, 2013 (FR) ..... 13 54716

(51) Int. Cl.
*F01D 9/06* (2006.01)
*F01D 25/28* (2006.01)
*F01D 9/04* (2006.01)

(52) U.S. Cl.
CPC ..... *F01D 9/065* (2013.01); *F01D 9/042* (2013.01); *F01D 25/28* (2013.01); *F05D 2260/30* (2013.01)

(58) Field of Classification Search
CPC . F01D 9/02; F01D 9/041; F01D 9/065; F01D 25/28; F05D 2240/90; F05D 2240/91; F05D 2260/30
See application file for complete search history.

(56) References Cited

U.S. PATENT DOCUMENTS 7,506,499 B2 * 3/2009 Fert ..... F01D 9/065 60/226.1
7,661,272 B2 * 2/2010 Gagneux ..... F01D 9/065 60/796

* cited by examiner

*Primary Examiner* — Moshe Wilensky
*Assistant Examiner* — Christopher R Legendre
(74) *Attorney, Agent, or Firm* — Womble Bond Dickinson (US) LLP

(57) ABSTRACT

Auxiliary lead-through device for a turbomachine, including two coaxial annular shell rings, respectively an inner and an outer one, between which there extend radial arms, through at least one of which auxiliaries (20) are led through. An auxiliary retention unit is housed inside the arm, on one wall, the arm includes an aperture that can be closed off by a cover that is attached and fixed to the arm. The retention unit includes at least one first member fixed to the internal surface of the arm and at least one second member fixed to the internal surface of the cover. The fixing of the cover to the arm causes the auxiliaries to be clamped and retained between the first and second members.

12 Claims, 3 Drawing Sheets

TURBOMACHINE AUXILIARY LEAD-THROUGH DEVICE

TECHNICAL FIELD

The present invention relates to a device for leading through auxiliary systems for a turbine engine, this device commonly being referred to as a "kit engine" in the field of aeronautics.

PRIOR ART

A device for leading through auxiliary systems or a kit engine comprises two respectively inner and outer coaxial annular collars, between which radial arms extend, through at least some of which arms auxiliary systems such as pipelines or ducts conveying fluids and electrical harnesses pass.

FR-A1-2 875 855, FR-A1-2 899 272 and EP-A1-1 741 849 describe arms for leading through auxiliary systems for a turbine engine, in particular with a removable cowl for having access to auxiliary systems in the last document.

The arms generally have a maximum cross section that is imposed by aerodynamic constraints that are linked in particular to the expected performance of the engine. Moreover, the auxiliary systems that pass through an arm have to be supported within the arm in order to prevent them from vibrating during operation and to prevent them from coming into contact with one another.

In the current art, the auxiliary systems are supported within the arm by brackets which are separate from the arms and grip a plurality of auxiliary systems while keeping them at a distance from one another. The kit engine is equipped with the auxiliary systems and the support brackets are mounted on the auxiliary systems and on the structural arms of the intermediate casing prior to mounting the arm of the kit engine on the intermediate casing.

However, some engines may comprise an arm for leading through auxiliary systems that has a relatively small maximum cross section, and this prevents the above-mentioned technology from being used to support the auxiliary systems within the arm. Indeed, when mounting the arm of the kit engine on the intermediate casing that is equipped with the auxiliary systems, the arm may come into contact with the brackets or the auxiliary systems, and this risks damaging the arm.

The aim of the present invention is to solve this problem in a simple, effective and economical manner.

SUMMARY OF THE INVENTION

The invention proposes a device for leading through auxiliary systems for a turbine engine, comprising two respectively inner and outer coaxial annular collars, between which radial arms extend, at least one of which is used for leading through auxiliary systems, and comprising means for supporting auxiliary systems that are housed within the arm, characterised in that the arm comprises, on one of its walls, a window that can be covered by a cowl that is attached and fastened to the arm, and in that the supporting means comprise at least one first member that is fastened to the inner surface of the arm and at least one second member that is fastened to the inner surface of the cowl, fastening the cowl to the arm causing the auxiliary systems to be clamped and supported between the first and second members.

The present invention thus proposes new technology for supporting auxiliary systems within an arm for leading through auxiliary systems, this technology preventing the arm and the means for supporting the auxiliary systems from contacting each other while the arm is being mounted, since these means are rigidly connected to the arm and are mounted on the auxiliary systems at the same time as the arm. The arm may be a kit-engine arm or another arm of the turbine engine, such as an arm of the exhaust casing.

Preferably, the window is formed on a side wall of the arm and the first supporting member is fastened to the inner surface of the other side wall of the arm, substantially opposite the window.

The window may be located on a middle portion or a portion that is substantially halfway up the arm.

The window may be parallelepiped in shape and may be delimited by peripheral edges of the arm that are radially inner, radially outer, upstream and downstream respectively.

The cowl may be fastened to the arm by any appropriate fastening means, such as screws, rivets, etc. The cowl is preferably of the removable type.

Advantageously, each member for supporting auxiliary systems comprises cavities that are complementary to parts of the auxiliary systems, with a view to said parts of the auxiliary systems fitting therein.

Each member may comprise a block of material in which the above-mentioned cavities are formed.

The present invention also relates to an arm for leading through auxiliary systems for a device as described above, characterised in that it comprises, on one of these walls, a window that can be covered by an attached cowl that is fastened to the arm, at least one first member for supporting auxiliary systems that is fastened to the inner surface of the arm and at least one second member for supporting auxiliary systems that is fastened to the inner surface of the cowl, fastening the cowl to the arm being intended to cause the auxiliary systems to be clamped and supported between the first and second members.

Preferably, the arm is substantially dihedral and comprises two side walls that are connected by the downstream edges thereof. The window may be formed on the middle portion of one of the side walls and may be at a distance from the upstream, downstream, radially inner and radially outer edges of this wall.

The present invention further relates to a turbine engine, such as a turbojet engine or a turboprop engine, characterised in that it comprises at least one device of the above-mentioned type.

The present invention lastly relates to a method for mounting a device as described above, characterised in that it comprises the steps of:

- mounting the arm for leading through auxiliary systems between the inner and outer collars by moving said arm in translation along the longitudinal axis of the turbine engine, the first supporting member, which is supported by this arm, being intended to extend on one side of the auxiliary systems,
- closing the window on the arm by means of the cowl, the second supporting member, which is supported by this cowl, being intended to extend on the opposite side of the auxiliary systems, and
- fastening the cowl to the arm such that the auxiliary systems are clamped and supported between the first and second members.

DESCRIPTION OF THE DRAWINGS

The invention will be better understood and other details, features and advantages of the invention will emerge upon reading the following description given by way of non-limiting example and with reference to the accompanying drawings, in which.

DETAILED DESCRIPTION

Figure 1:
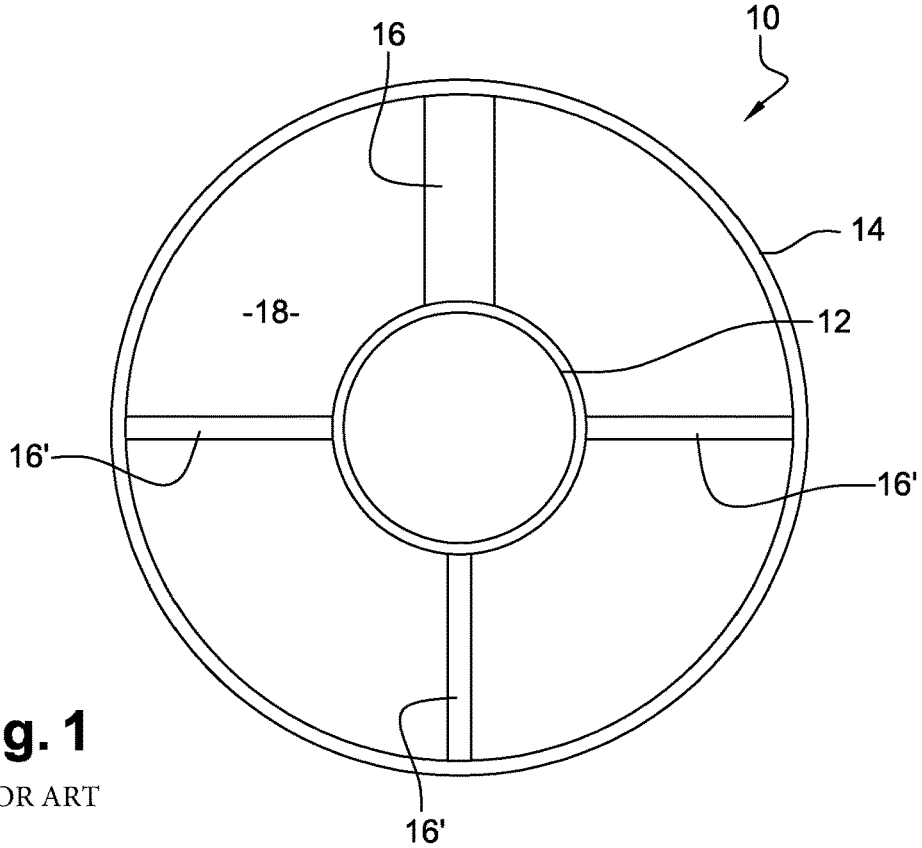
Fig. 1 PRIOR ART
FIG. 1 is a highly schematic front view of a device for leading through auxiliary systems for a turbine engine.

Reference is first made to FIG. 1, which is a highly schematic view of a device 10 for leading through auxiliary systems, which is also referred to as a "kit engine", for a turbine engine, such as a turbojet engine or a turboprop engine of an aeroplane, this kit engine 10 typically comprising two respectively inner 12 and outer 14 coaxial annular collars, between which radial arms 16, 16' extend. In a bypass turbojet engine, this kit engine 10 is mounted between the low-pressure and high-pressure compressors of the engine, the collars 12, 14 delimiting the annular flow duct 18 through which the secondary flow passes.

In the example shown, the kit engine 10 comprises four arms 16, 16', which are located at 3 o'clock, 6 o'clock, 9 o'clock and 12 o'clock respectively, if the analogy of a clock face is used. The arms 16, 16' have profiles and transverse dimensions that depend in particular on their function and on the aerodynamic constraints that are linked in particular to the expected performance of the engine.

Here, the kit engine 10 comprises an arm 16 at 12 o'clock that is relatively thick in cross section, that is to say having a relatively high maximum cross section, and three arms 16' at 3 o'clock, 6 o'clock and 9 o'clock that are relatively thin in cross section, that is to say that they have a relatively low maximum cross section.

Figure 2:
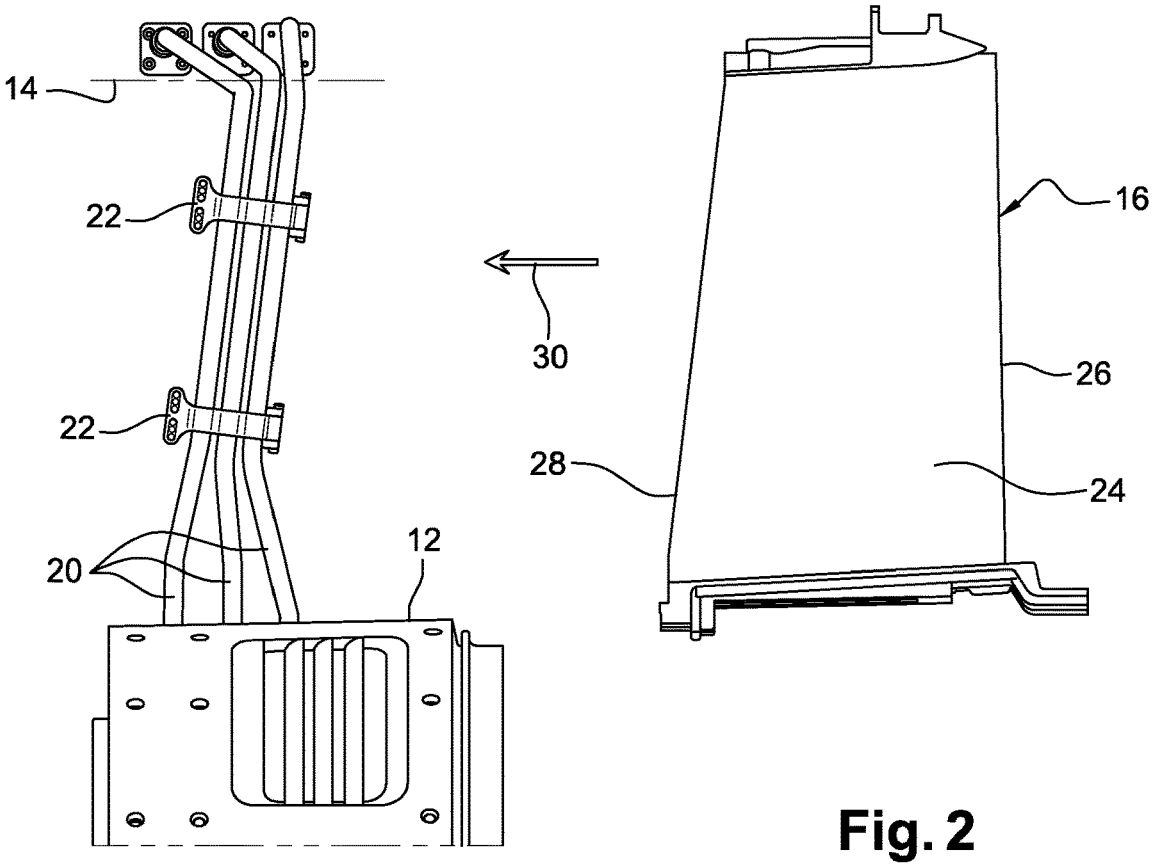
Fig. 2 PRIOR ART
FIG. 2 is a schematic perspective view of the auxiliary systems and an arm for leading through these auxiliary systems of a device for leading through auxiliary systems, according to the prior art of the invention.

FIG. 2 shows the technology from the prior art for supporting the auxiliary systems within an arm for leading through auxiliary systems, when this arm has a sufficient maximum cross section, as is the case for the arm 16 from FIG. 1.

The auxiliary systems 20 may be ducts, pipelines, electrical harnesses, etc. They extend between the inner 12 and outer 14 collars, substantially radially relative to the longitudinal axis of the kit engine. They are rigidly kept at a distance from one another by means of two brackets 22, each bracket surrounding the auxiliary systems (there are two in the example shown).

The arm 16 is dihedral and comprises two side walls 24 that are substantially parallelepiped in shape, the downstream radial edges 26 of which are interconnected. The upstream radial edges 28 are at a transverse or circumferential distance from one another and define an upstream opening in the arm, through which the auxiliary systems 20 enter the arm.

The arm 16 is mounted between the collars 12, 14 of the kit engine by moving said arm in translation from the downstream end in a direction parallel to the longitudinal axis of the kit engine (arrow 30), until the side walls 24 of the arm are arranged on either side of the auxiliary systems 20. The maximum cross section of the arm 16 is such that the side walls 24 of the arm are at a sufficient distance from one another that the brackets 22 for supporting the auxiliary system do not come into contact with these walls when mounting the arm.

However, this technology cannot be used for leading auxiliary systems through the arms which have too small a maximum cross section, such as the arms 16' in FIG. 1, since there is a risk that the above-mentioned brackets will come into contact with the arm and damage it when it is being mounted.

The invention makes it possible to overcome this problem owing to means for supporting the auxiliary systems which are rigidly connected to the arm for leading through the auxiliary systems and which are mounted on the auxiliary systems at the same time as the arm.

FIGS. 3 to 6 show an embodiment of the invention in which the arm 16' differs from that 16 previously described in particular in that it comprises a window 32 on one of these lateral walls 24. In this case, the window is formed in a middle portion of the wall 24, at a distance from the downstream 26 and upstream 28 radial edges of the arm.

This window 32 is substantially parallelepiped in shape and comprises radially outer 34, radially inner 36, upstream 38 and downstream 40 peripheral edges.

Figure 6:
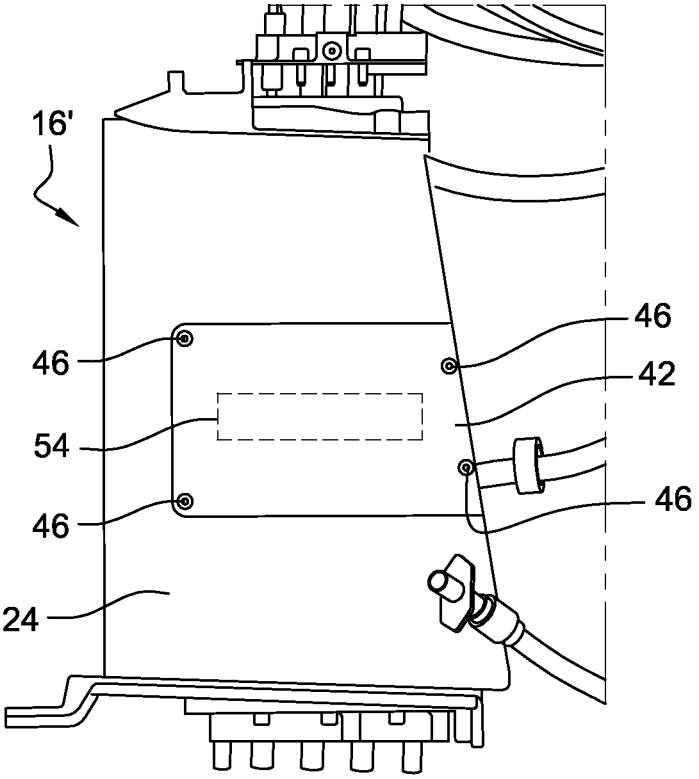
FIG. 6 is a schematic perspective view of the arm from FIG. 3, of which the side window has been closed by a cowl.

This window 32 is intended to be closed by a cowl 42 which abuts a peripheral rim 44 extending over the entire periphery of the window (FIG. 6). The cowl 42 is parallelepiped in shape and comprises apertures 46 that are aligned with apertures 48 in the rim 44 for screws or rivets to pass through for fastening the cowl to the arm.

In the mounted position shown in FIG. 6, the outer surface of the cowl 42 is aligned with the outer surface of the side wall 24 to which this cowl is fastened.

The inner surface of the cowl 42 and inner surface 50 of the side wall 24 opposite the cowl each support a member 52, 54 for supporting the auxiliary systems 20 within the arm, these members 52, 54 cooperating with one another when mounting the cowl in order to immobilise the auxiliary systems relative to one another.

Figure 3:
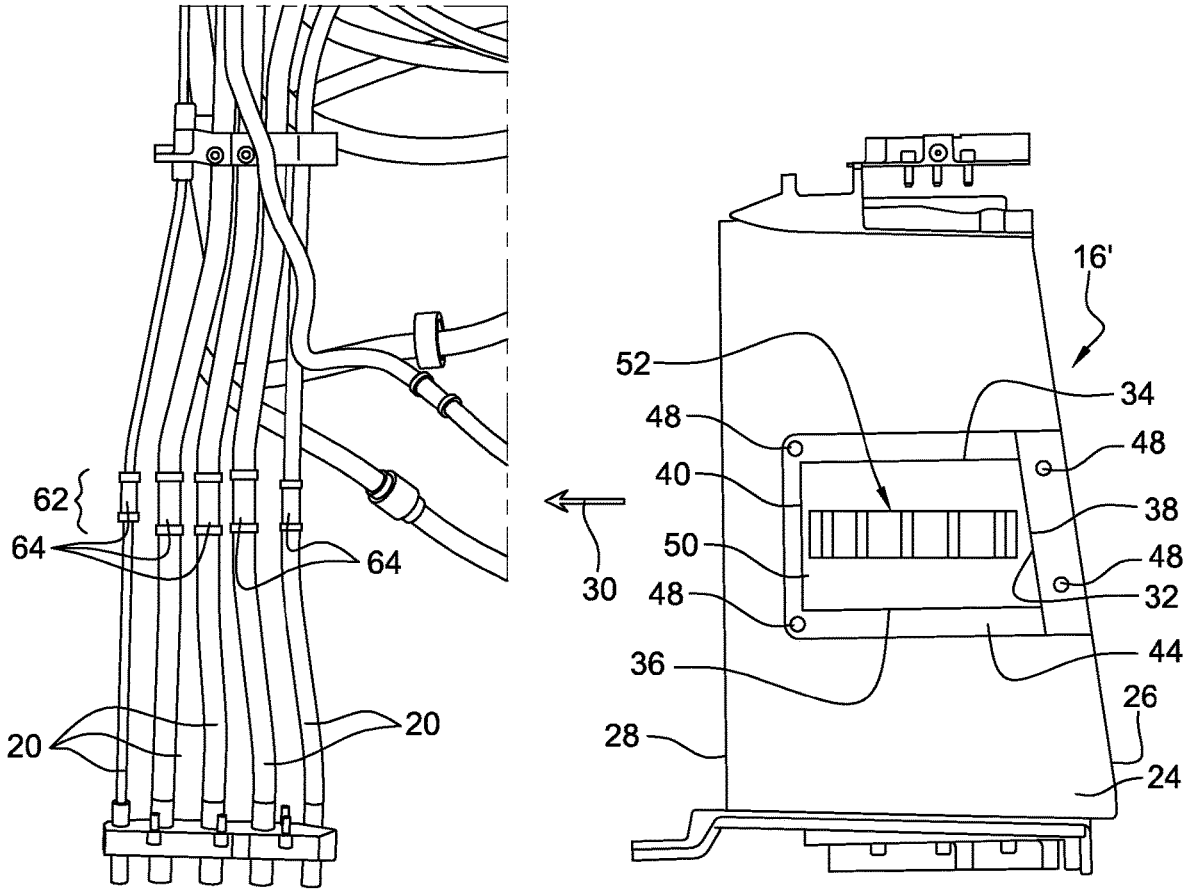
FIG. 3 is a schematic perspective view of the auxiliary systems and an arm for leading through these auxiliary systems of a device for leading through auxiliary systems according to the invention.

A first supporting member 52 is fastened to the inner surface of the side wall 24, substantially opposite the window 32 on the other side wall 24 (FIG. 3). The second supporting member 54 is fastened to the inner surface of the cowl and is intended to be located opposite the first means 52 when the cowl is mounted on the arm (FIG. 6).

The members 52, 54 may be fastened to the arm 16' and the cowl 42 by means of bonding, welding, brazing, etc.

Figure 4:
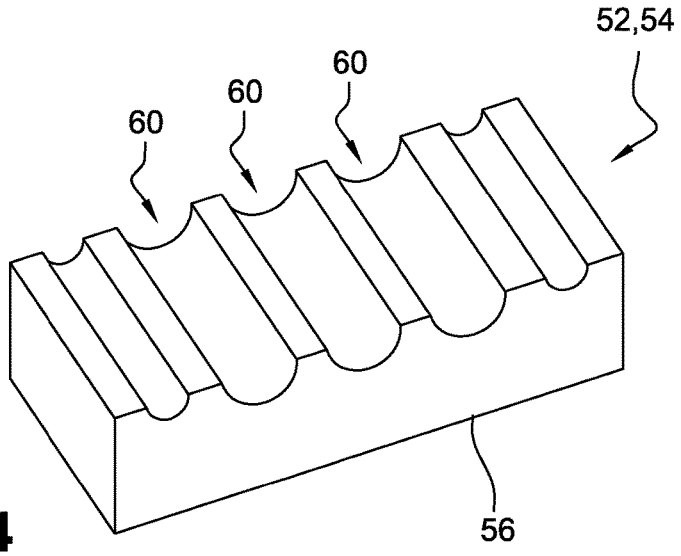
FIG. 4 is a schematic perspective view of a member for supporting the auxiliary systems within the arm according to the invention.

One embodiment of a supporting member 52, 54 is shown in FIG. 4. The supporting members 52, 54 may be identical and may each be formed by a block of material, for example made of metal, plastics, elastomer, etc., of which one face 56 is intended to be applied against the above-mentioned inner surface and of which the opposite face 58 comprises cavities 60 for receiving and fitting the auxiliary systems 20 therein.

In the example shown, five auxiliary systems 20 pass through the arm 16' and the block of material of each member 52, 54 comprises five cavities 60 on its face 58, each cavity comprising an elongate and rectilinear groove, which has a semi-circular cross section of which the diameter is substantially equal to or slightly greater than that of the corresponding auxiliary system. The grooves of the cavities 60 are in parallel and at a distance from one another in order to keep the auxiliary systems at a distance from one another.

As can be seen in FIG. 3, the block of the member 52 has an elongate shape and has an orientation that is substantially parallel to the longitudinal axis of the kit engine and therefore extends substantially perpendicularly to the auxiliary systems 20.

The middle portions 62 of the auxiliary systems 20 are intended to be inserted into the cavities 60 in the block of the member 52. The middle portion 62 of each auxiliary system bears a cylindrical ring 64 that is intended to protect and support the auxiliary system when mounting the cowl.

When the cowl 42 is mounted on the arm 16', the auxiliary systems 20 are intended to be inserted into the cavities 60 in the block of the member 54 supported by the cowl. Fastening the cowl 42 to the arm causes the middle portions 62 of the auxiliary systems to be clamped between the blocks of the members 52, 54, that is to say that, in the mounting position shown in FIG. 6, the supporting members 52, 54 are designed such that they clamp and immobilise the auxiliary systems 20. In this mounting position, the faces 58 of the blocks of the members 52, 54 may be in abutment with one another or may be at a distance from one another.

Figure 5:
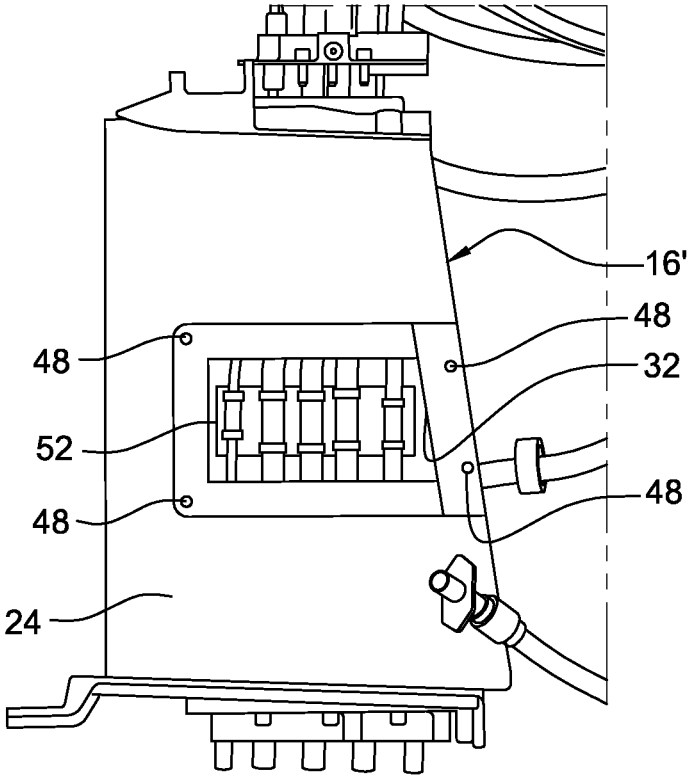
FIG. 5 is a schematic perspective view of the arm from FIG. 3, through which the auxiliary systems pass.

Mounting the arm 16' in a kit engine 10 equipped with auxiliary systems will now be described. The arm 16' is positioned downstream of the auxiliary systems, as shown in FIG. 3, and then it is moved in the upstream direction in translation along the longitudinal axis of the kit engine (arrow 30). It may be necessary to move the middle portions 62 of the auxiliary systems 20 (which are relatively flexible) in order to allow the block of the member 52 on one of the sides of the auxiliary systems and to insert these middle portions into the cavities 60 in this block. The mounting shown in FIG. 5 is thus achieved, in which the middle portion of each auxiliary system is received in a cavity in the block of the member 52. The cowl 42 is then attached and fastened to the arm, and this causes the auxiliary systems to be clamped and immobilised between the blocks of the members 52, 54.

Although the invention has been described with respect to an arm having a reduced maximum cross section, it is not restricted to this type of arm and may be used in an arm having a larger maximum cross section, for example to replace the technology for supporting the auxiliary systems that is described with reference to FIG. 2.

What is claimed is:

1. A device for leading through auxiliary systems for a turbine engine, comprising two respectively inner and outer coaxial annular collars, between which radial arms extend, and supports for supporting said auxiliary systems, wherein at least one radial arm of said radial arms is used for leading through said auxiliary systems, and said supports for supporting said auxiliary systems are housed within said at least one radial arm, wherein said at least one radial arm comprises at least a first wall and a second wall and one of said first and second walls includes a window covered by a cowl, wherein the supports for supporting said auxiliary systems comprise at least one first supporting member that is fastened to an inner surface of said at least one radial arm and at least one second supporting member that is fastened to an inner surface of the cowl, wherein the cowl is fastened to said at least one radial arm causing said auxiliary systems to be clamped and supported between said at least one first supporting member and said at least one second supporting member.

2. The device according to claim 1, wherein, for each radial arm of the at least one radial arm, the window is formed on the first wall of said radial arm and the first supporting member is fastened to the inner surface of the second wall of said at least one radial arm, substantially opposite the window.

3. The device according to claim 1, wherein, for each radial arm of the at least one radial arm, the window is located on a middle portion of said radial arm.

4. The device according to claim 1, wherein, for each radial arm of the at least one radial arm, the window is parallelepiped in shape and is delimited by peripheral edges of said radial arm that are radially inner, radially outer, upstream and downstream respectively.

5. The device according to claim 1, wherein, for each radial arm of the at least one radial arm, each said at least first supporting member and each said at least second supporting member comprises cavities that are complementary to parts of the auxiliary systems, wherein said parts of the auxiliary systems fit in the cavities.

6. The device according to claim 5, wherein, for each radial arm of the at least one radial arm, each said at least first supporting member and each said at least second supporting member comprises a block of material in which the cavities are formed.

7. The turbine engine, comprising at least one device according to claim 1.

8. The turbine engine according to claim 7 wherein the turbine engine is a turbojet engine for an airplane.

9. The turbine engine according to claim 7 wherein the turbine engine is a turboprop engine for an airplane.

10. A method for mounting a device according to claim 1, comprising the steps of:

mounting said at least one radial arm intended for leading through said auxiliary systems between the inner and outer collars by moving said at least one radial arm in translation along a longitudinal axis of the turbine engine, said first supporting member, which is supported by the said at least one radial arm, extending on one side of said auxiliary systems, closing the window on said at least one radial arm by means of the cowl, said second supporting member, which is supported by the cowl, extending on a side of said auxiliary systems opposite said one side of the auxiliary systems, and fastening the cowl to said at least one radial arm such that said auxiliary systems are clamped and supported between the first supporting member and the second supporting member.

11. A radial arm of a device for leading through auxiliary systems of a turbine engine, wherein said radial arm comprises:

first and second walls, a window on one of said first and second walls, said window that is covered by a cowl that is attached to the one of said first and second walls, at least a first supporting member for supporting said auxiliary systems that is attached to an inner surface of said radial arm and;

a second supporting member that supports said auxiliary systems and is attached to an inner surface of the cowl, wherein the attachment of the cowl to said radial arm causes the auxiliary systems to be clamped and supported between the first and second supporting members.

12. The radial arm according to claim 11, wherein said radial arm is substantially dihedral and the first and the second walls and connected by downstream edges thereof, the window being formed on a middle portion of the one of the first and the second walls and being spaced apart from each of upstream edges, the downstream edges, radially inner edges and radially outer edges of the one of the first and second walls.

* * * * *